US006283402B1

(12) United States Patent
Fordham

(10) Patent No.: US 6,283,402 B1
(45) Date of Patent: Sep. 4, 2001

(54) REWINDER METHOD AND APPARATUS

(75) Inventor: Keith Gary Fordham, Stowmarket (GB)

(73) Assignee: Ashe Controls, Ltd. (GB)

( * ) Notice: Subject to any disclaimer, the term of this patent is extended or adjusted under 35 U.S.C. 154(b) by 0 days.

(21) Appl. No.: 09/335,856

(22) Filed: Jun. 17, 1999

(51) Int. Cl.[7] ..... B65H 18/10; B65H 18/16; B65H 19/30; B65H 23/04

(52) U.S. Cl. ..... 242/525.1; 242/530.4; 242/533.7; 242/541.1; 242/547.7; 242/547; 242/548

(58) Field of Search ..... 242/525, 525.1, 242/530, 530.4, 530.3, 533.7, 541.1, 541.4, 541.5, 541.6, 541.7, 547, 548, 534, 534.2, 530.1

(56) References Cited

U.S. PATENT DOCUMENTS

| | | | | |
|---|---|---|---|---|
| 2,392,148 | * | 1/1946 | Hornbostel | 242/541.1 |
| 2,777,644 | * | 1/1957 | Nicholson | 242/530 |
| 4,171,107 | * | 10/1979 | Kayser et al. | 242/541.6 |
| 4,208,019 | * | 6/1980 | Dusenbery | 242/530.4 |
| 4,440,356 | * | 4/1984 | Lang | 242/525.1 |
| 4,491,283 | * | 1/1985 | Pav et al. | 242/534.2 |
| 4,697,755 | * | 10/1987 | Kataoka | 242/530.4 |
| 4,858,843 | * | 8/1989 | Gierse et al. | 242/548 |
| 5,249,758 | * | 10/1993 | Muller et al. | 242/541.5 |
| 5,377,931 | * | 1/1995 | Dorfel et al. | 242/530 |
| 5,437,417 | * | 8/1995 | Kammann | 242/541.1 |
| 5,791,583 | * | 8/1998 | Alexander et al. | 242/541.1 |
| 5,806,783 | * | 9/1998 | Turunen | 242/530.1 |
| 5,850,982 | * | 12/1998 | Roth et al. | 242/548 |
| 5,853,139 | * | 12/1998 | Hehner et al. | 242/530.1 |
| 6,062,507 | * | 5/2000 | Summey | 242/541.6 |
| 6,149,098 | * | 11/2000 | Kuhn et al. | 242/530.4 |

* cited by examiner

*Primary Examiner*—John M. Jillions
(74) *Attorney, Agent, or Firm*—Townsend and Townsend and Crew LLP

(57) ABSTRACT

A reeled feed web is unreeled and passed through a set of slitting knives before the slit webs are rewound on rewind reels each carried by one of two differential or lock-bar shafts. The shafts are fixed in position and the slitting knives and rollers for handling the feed web and the slit webs are mounted on a movable carriage which can be traversed towards or away from the shafts. The carriage includes two mounting beams, parallel to the shafts, on which lay-on rollers can be mounted for guiding or laying-on slit webs onto respective rewind reels carried by the shafts. Variable predetermined torques can be applied to the rewind reels and the lay-on rollers, and the movement of the carriage controlled, to implement any of the following winding geometries; center winding, center winding with lay-on, surface winding, center surface winding and constant gap winding. The shafts are cantilevered so that reels can be unloaded from the ends of the shafts.

14 Claims, 10 Drawing Sheets

10
12
14
18
20
22
24
26
28
30
32
34
36
38
40
42
44
46
48
50
52
54
56
58
60
62
64
66
68
70
73
74
80
81
A
B
10
20
30
40
50
60
70

REWINDER METHOD AND APPARATUS

FIELD OF THE INVENTION

The invention relates to a rewinder method and apparatus for rewinding reeled webs of material and in particular to a multi-function slitter rewinder for slitting and rewinding reeled webs.

DESCRIPTION OF THE BACKGROUND ART

Various types of slitter rewinder machine are in use, each having advantages and disadvantages and each being suited to and manufactured for particular applications. These types of machine can be categorised according to their rewinding geometry, including centre wind, centre wind with contact lay-on, surface wind, centre surface wind and constant-gap winding. These geometries are illustrated respectively in FIGS. 1 to 5, showing the rewind reel 2, web 4 and contact roller 6 (if present).

Centre winding (FIG. 1) is the simplest geometry, the reel itself being driven and the web being drawn tangentially onto the reel. A machine using this arrangement is simple to operate and unload and can run at high speed. However, there is a tendency for air to be trapped beneath the web as it is drawn onto the reel. This reduces the precision of winding and renders this technique unsuitable for certain web materials and web widths.

Centre winding with contact lay-on (FIG. 2) reduces the entrapment of air, the air being excluded by the pressure between the lay-on roller and the reeled web. This arrangement improves accuracy but still can not be used with certain web materials, such as fragile or elastic materials.

These centre wind geometries are typically used in duplex centre winding machines, in which reels may be wound on either of two laterally-spaced parallel shafts. This enables a wider web (carried on a third parallel shaft) to be slit into a plurality of narrower webs, adjacent narrower webs being rewound onto alternate rewind shafts of the duplex centre winder.

In a surface winder (FIG. 3) a lay-on, or contact, roller is used but the lay-on roller is driven and the rewind reel is not. The pressure of the lay-on roller on the surface of the rewind reel is sufficient to drive the rewind reel. This system has the advantage that the web can be wound onto the rewind reel under very low tension. This is suitable for fragile or elastic web materials.

Centre surface winding (FIG. 4) entails the use of a lay-on roller but both the lay-on roller and the rewind reel are driven. This allows optimum control of the web tension on the rewind reel but increases the complexity and cost of the machine compared with a simple centre wind system. In particular, reel loading and unloading is more complicated and so reel change over times are disadvantageously long.

In constant gap winding (FIG. 5), an idle roller is used for guiding the web onto the rewind reel during centre winding. The idle roller does not contact the rewind reel but is moved away from the rewinder reel shaft during winding so as to keep constant the distance travelled by the web between the idle roller and the rewind reel.

The performance of these conventional rewind machines is becoming more of a problem as environmental pressures require reduced waste and reduced quantity of packaging materials (for which web materials are commonly used), which leads to the development of web materials having higher barrier properties, thinner films and papers, and environmentally friendly inks. Such materials become more difficult to handle and therefore expose the limitations of conventional rewinding machines.

STATEMENT OF THE INVENTION

It is an object of the invention to overcome the problems of prior art rewinding machines as described above.

It is a further object of the invention to improve on the winding performance of prior art rewinding machines.

It is a further object of the invention to provide a rewinding machine having greater flexibility of winding geometry than in the prior art.

It is a still further object of the invention to enable surface winding geometries with improved reel handling, particularly for reel unloading.

The invention provides in its various aspects a rewinding apparatus, a rewinding method and an unloading method as defined in the appended independent claims. Preferred or advantageous features of the invention are set out in dependent subclaims.

The invention thus provides a method and an apparatus in which a rewind reel is mounted on a shaft and in which a lay-on roller can be traversed laterally so that it moves away from the shaft as the diameter of the rewind reel increases during winding. The rewind reel and/or the lay-on roller may or may not be driven such that the method and apparatus of the invention can implement centre winding with contact lay-on, surface winding or centre surface winding depending on whether the reel and/or the lay-on roller is driven. In addition, if the lay-on roller is bypassed or held in a fixed position distant from the rewind shaft, and the rewind reel driven, centre winding can be achieved.

Advantageously, constant gap winding can also be achieved by traversing a guide (or idle) roller away from the rewind shaft during rewinding.

Advantageously, the invention may be implemented in a duplex rewinder and combined with a slitting function.

According to a second aspect, the invention also provides a method and apparatus for implementing the speed and ease of loading and unloading conventionally associated with a centre winding machine in a machine which is also capable of surface winding and constant gap winding. Rewind reels may thus be unloaded axially from the or each rewind shaft.

Thus, in a preferred embodiment, the invention may advantageously provide a method and apparatus in which a reeled feed web is unreeled and passed through a set of slitting knives before the slit webs are rewound on rewind reels each carried by one of two differential or lock-bar shafts. The shafts are fixed in position and the slitting knives and rollers for handling the feed web and the slit webs are mounted on a movable carriage which can be traversed towards or away from the shafts. The carriage includes two mounting beams, parallel to the shafts, on which lay-on rollers can be mounted for guiding or laying-on slit webs onto respective rewind reels carried by the shafts. Variable predetermined torques can be applied to the rewind reels and the lay-on rollers, and the movement of the carriage controlled, to implement any of the following winding geometries; centre winding, centre winding with lay-on, surface winding, centre surface winding and constant gap winding. The shafts are cantilevered so that reels can be unloaded from the ends of the shafts.

DESCRIPTION OF THE BEST MODE AND SPECIFIC EMBODIMENT

Specific embodiments of the invention will now be described by way of example with reference to the drawings, in which:

FIG. 11 shows the overall layout of a duplex rewinder 10 embodying the invention. It comprises two vertically-spaced horizontal shafts 12, 14 for carrying rewind reels.

The shafts are cantilevered at one end from a motor unit 16. Each shaft carries a row of variable-torque clutches along its length over which cores for reels for rewinding can be positioned. The clutches are controllable in known manner so that the cores can be driven with predetermined torque or can rotate freely. Each controllable-torque clutch is known in the art as a differential chuck and each shaft carrying a row of differential chucks is termed a differential shaft 12, 14. (Although the best mode of the invention as described herein in relation to the illustrated embodiments employs differential shafts, the invention is equally applicable to machines using conventional lock-bar shafts).

Figures 6, 8:
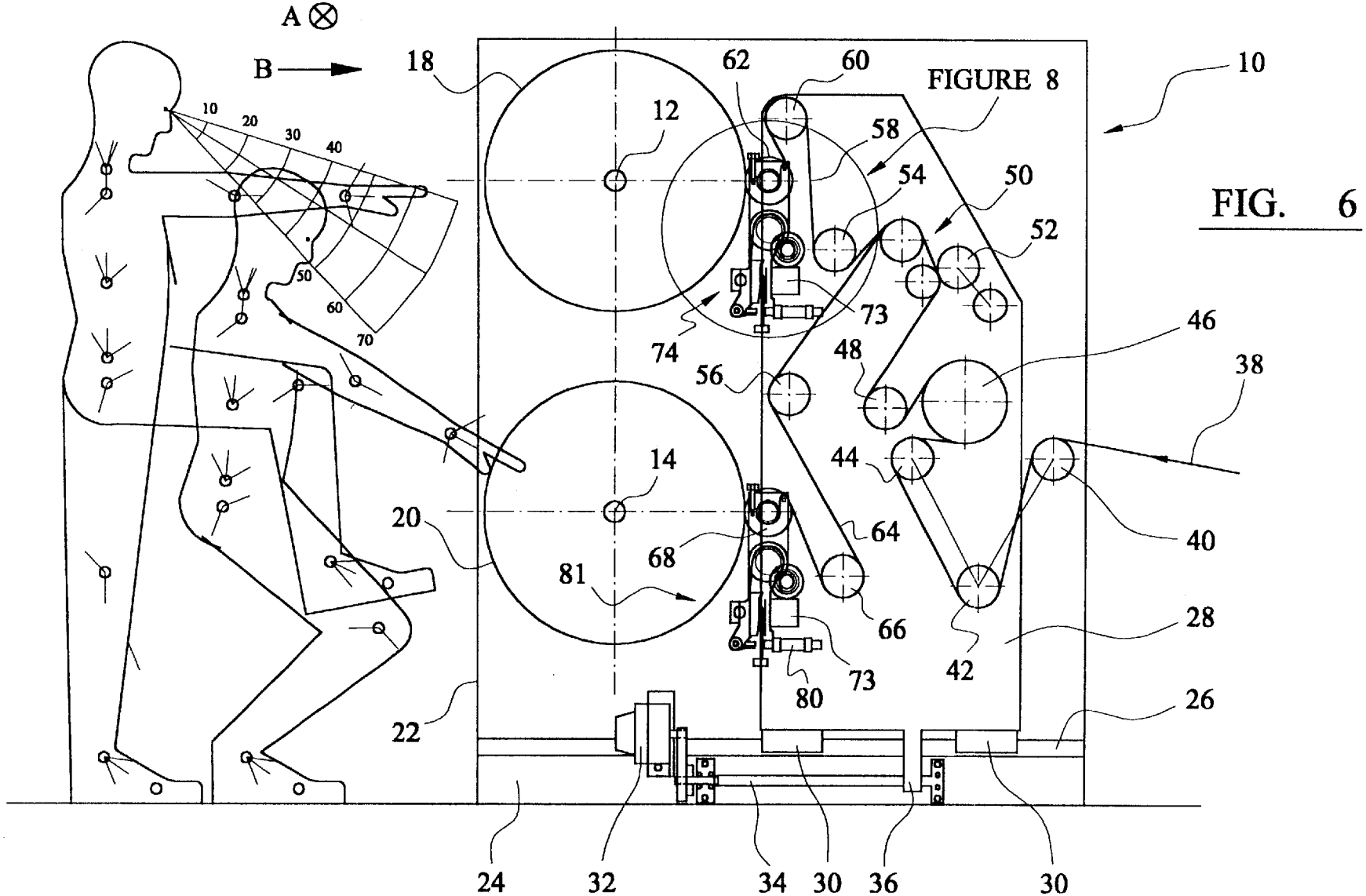
FIG. 6 is a transverse section of a duplex rewinder according to an embodiment of the invention, sectioned on A—A in FIG. 7.
FIG. 8 is an enlarged view of the lay-on roller assembly of the embodiment of FIG. 6.
Figure 11:
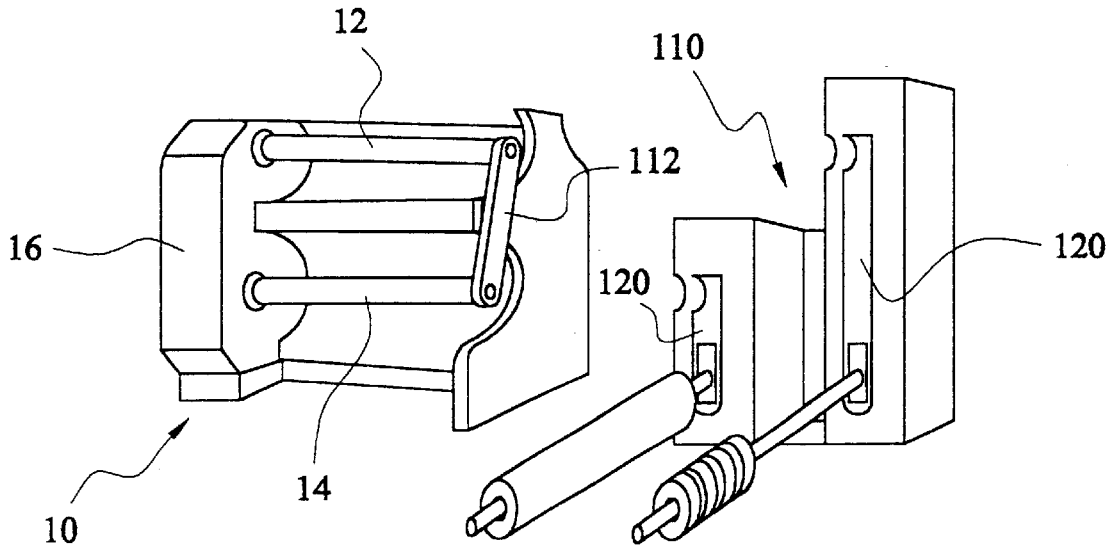
FIG. 11 is a perspective view of the embodiment of FIG. 6 after unloading.

FIG. 6 is a transverse section through a duplex rewinder embodying the invention as illustrated in FIG. 11. The cantilevered differential shafts 12, 14 are illustrated within rewind reels 18, 20 approaching their maximum diameter. The main frame 22 of the rewinder is mounted on a base 24 and carries two horizontal linear slides 26 near the base 24. The slides are perpendicular to the differential shafts and carry a carriage 28 mounted on linear slide bearings 30. The carriage can be driven along the slides, towards the front or rear of the rewinder, by a motor 32 and a carriage drive assembly mounted on the frame 22. The carriage drive assembly comprises a threaded shaft 34 rotatable in a threaded portion 36 of the carriage. The carriage drive assembly also comprises a positional sensor to detect the position of the carriage.

The moving carriage 28 carries rollers for guiding web material from a feed roller (not shown) to the rewind reel, and a slitting knife assembly to slit the feed web if required before rewinding.

The feed web 38 enters the rear of the carriage via a fixed position idle roller 40 followed by a floating idle roller 42 and a moving idle roller 44 before passing around a main driven roller 46 which controls the feed web speed. The fixed, floating and moving idle rollers 40, 42, 44 compensate for variations in feed web length as the carriage 28 is moved in order to keep the feed web tight.

From the main driven roller 46, the feed web passes over an idle roller 48 and into the slitting knife assembly 50, which comprises a number of rotary slitting knives 52. The number and position of the knives depends on the required cutting of the feed web.

If the feed web is slit, then two or more rewind webs emerge from the slitting knife assembly 50. Adjacent slit webs are rewound on cores on the upper and lower differential shafts respectively to prevent interference between the edges of the slit webs. Thus, from the slitting knife assembly 50, alternate slit webs are directed around idle rollers 54, 56 towards the upper or lower differential shaft. The further route of each slit web depends on the rewinding geometry to be used as described below.

Figure 7:
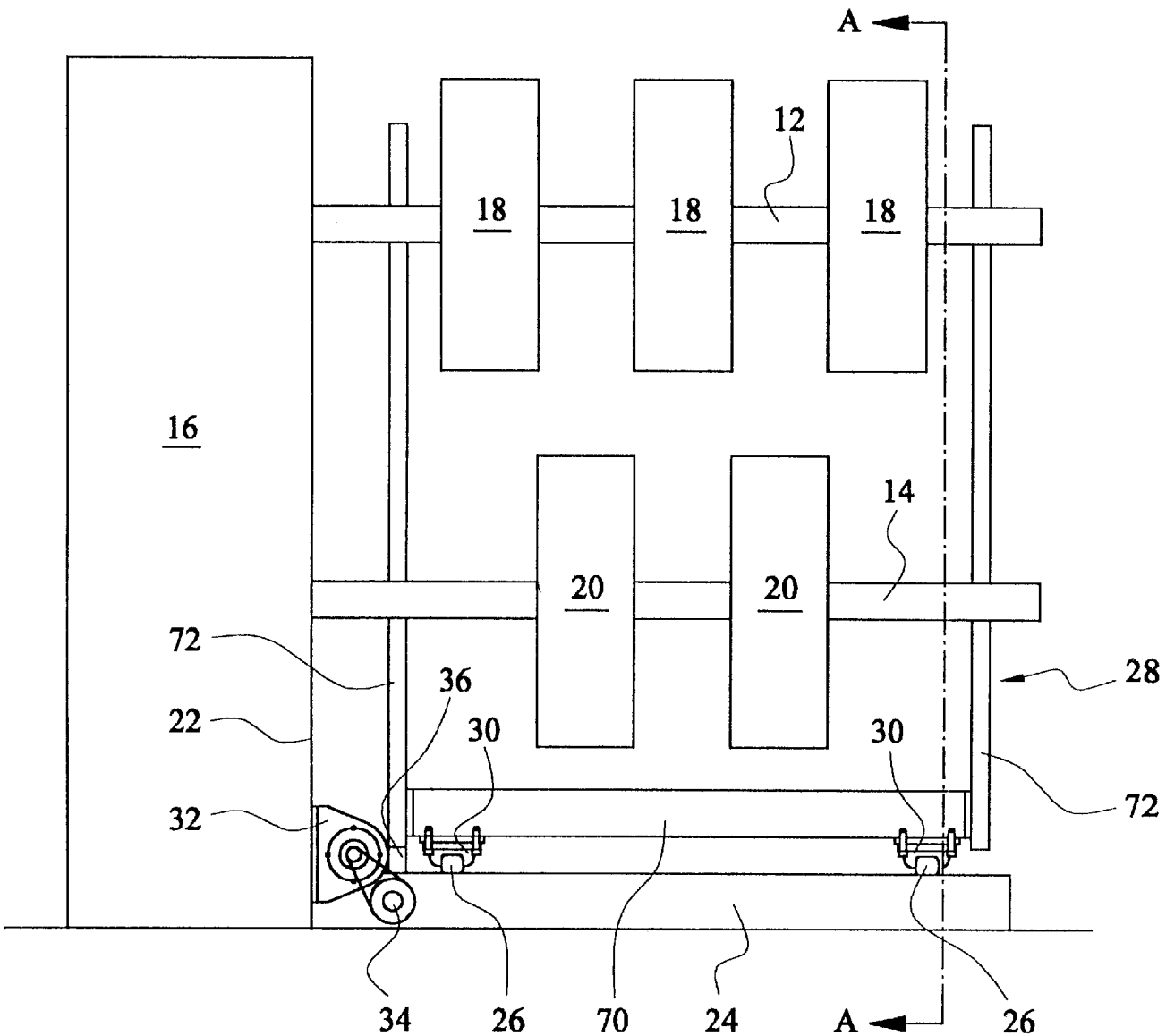
FIG. 7 is a front view of the embodiment of FIG. 6, viewed from direction B.
Figure 8:
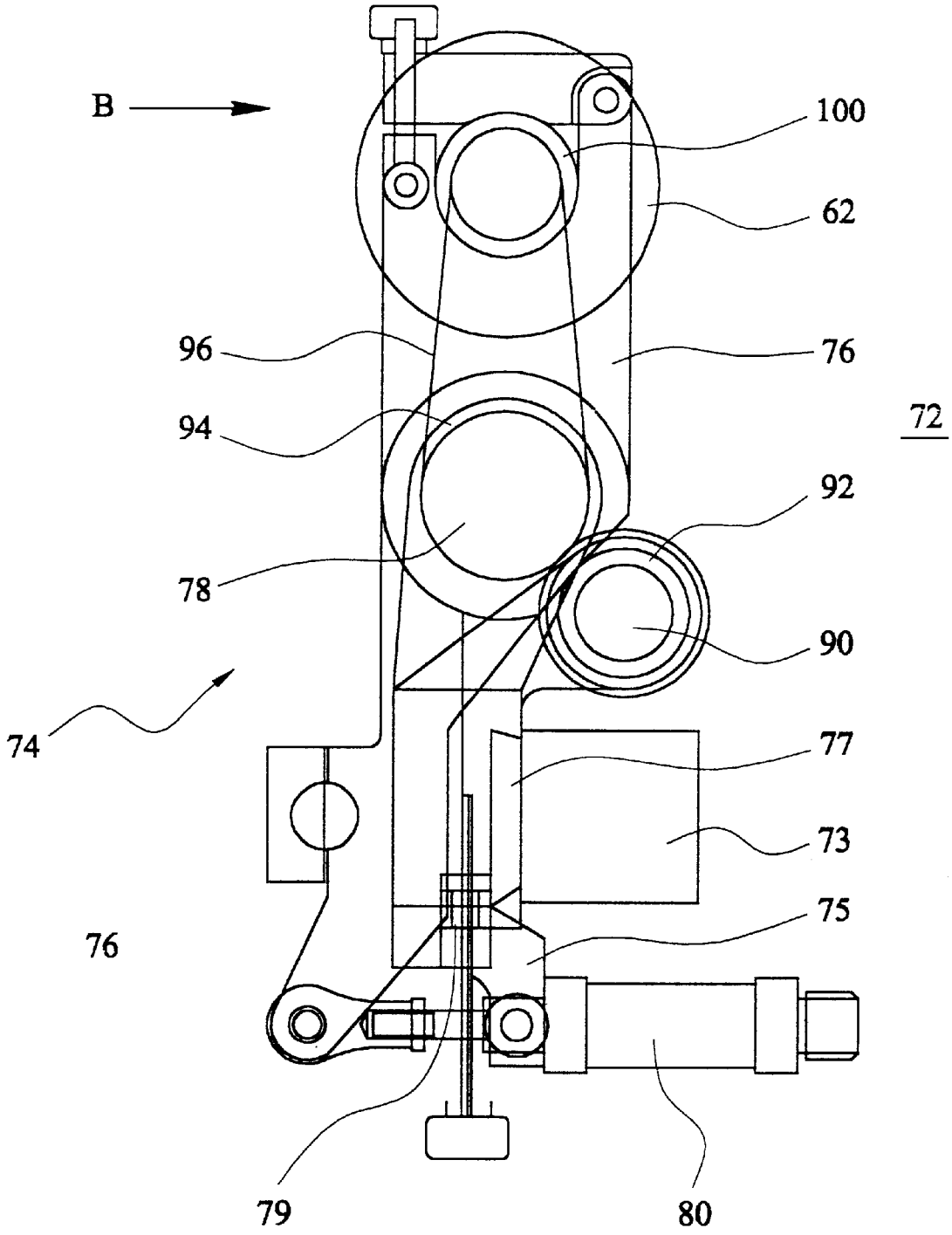

FIG. 6 relates to an embodiment in which the feed web is slit into five slit webs, three being rewound on the upper differential shaft and two on the lower differential shaft as shown in FIG. 7 (as described below). FIG. 6 illustrates a surface wind geometry with, by way of example, the upper reels 18 rotating anticlockwise and the lower reels 20 rotating clockwise. To achieve this, each slit web (upper slit web 58) directed to the upper differential shaft passes over a final idle roller 60 and onto a driven lay-on roller 62. Each upper slit web 58 is thus laid onto a respective rewind reel 18, which is free to rotate on the upper differential shaft 12.

Each slit web (lower slit web 64) to be wound on a reel carried by the lower differential shaft 14 passes around a final idle roller 66 and onto a lower driven lay-on roller 68. Each lower slit web 64 is thus laid onto a respective rewind reel, which is free to rotate on the lower differential shaft 14.

In some implementations, upper and/or lower lay-on rollers each spanning the width of the carriage may be used but it is also possible to use individual lay-on rollers for each web or slit web to be rewound. For example, if two or more slit webs are rewound using a common lay-on roller, web gauge variations can cause the different slit webs to be rewound with different tensions or with poor reliability because the diameters of the different rewind reels may not increase at identical rates during rewinding. This problem is most severe in winding geometries in which the lay-on roller is driven and/or contacts the rewind reel, when an individual lay-on roller would preferably be used for each slit web. By contrast, a single lay-on roller carrying two or more webs may advantageously be used for centre winding.

Although the rollers over which each web or slit web passes immediately before (upstream of) the rewind reel are described consistently herein as lay-on rollers for the sake of clarity, it should be noted that in certain winding geometries they may conventionally be termed contact rollers or guide rollers.

The structure of the lay-on rollers is described in more detail below in relation to FIGS. 8 and 9.

FIG. 7 is a front view of the duplex rewinder of the embodiment. It shows the differential shafts 12, 14 cantilevered from the motor unit 16, and the carriage drive motor 32 and threaded shaft 34 mounted on the frame 22 and the base 24. It also shows more detail of the moving carriage 28, which comprises a horizontal base 70 from which side plates 72 extend upwards. The rollers and slitting knife assembly described above are supported between the side plates 72. The base of the carriage is fastened to the linear bearings 30 on which the carriage slides.

Figure 9:
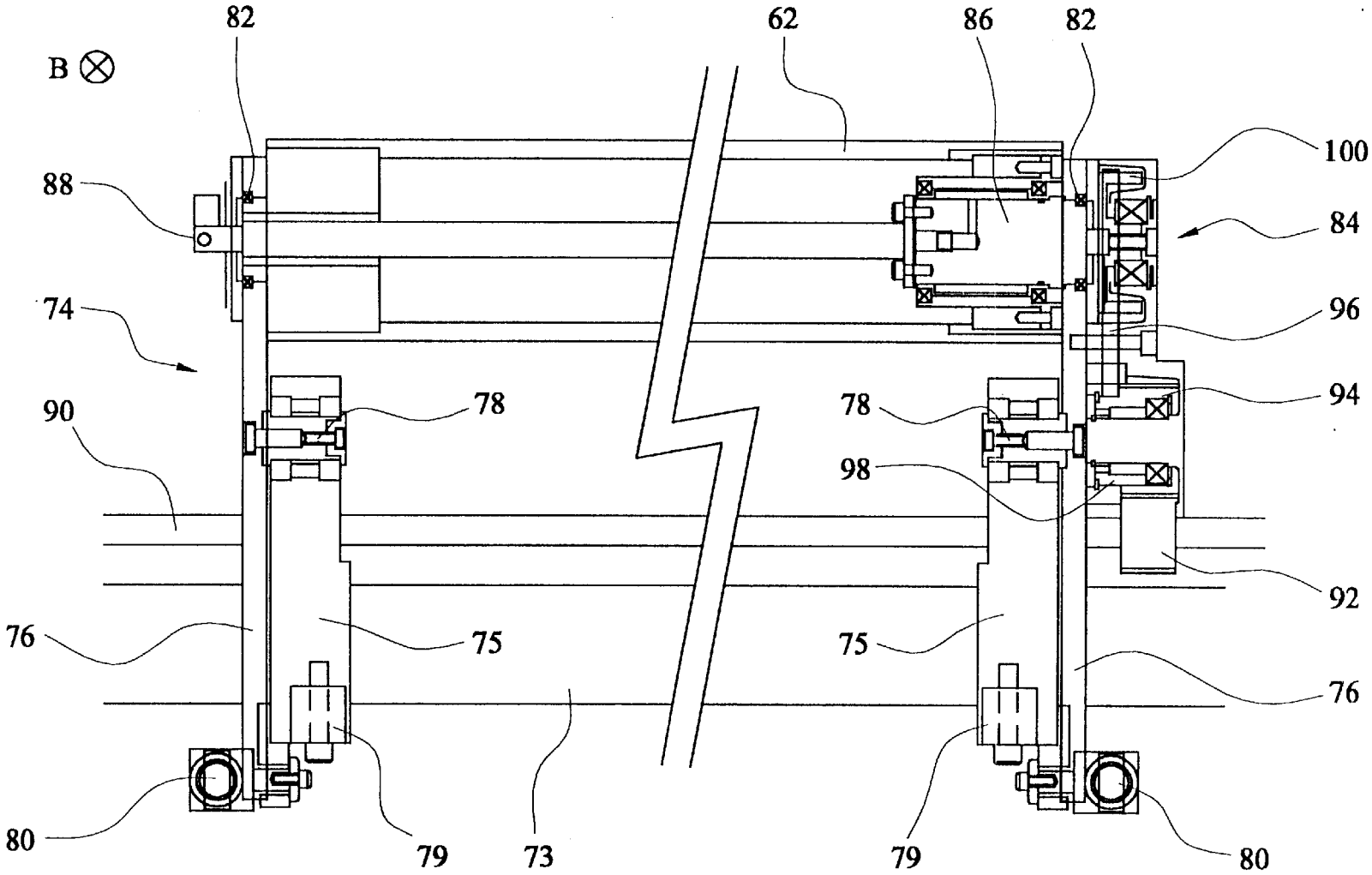
FIG. 9 is a front view of the lay-on roller assembly of FIG. 8, viewed from direction B.

FIGS. 8 and 9 illustrate in greater detail the means for positioning and driving the or each upper lay-on roller 62. Each such unit is termed a lay-on roller assembly. Similar lay-on roller assemblies 74, 81 are used at the upper and lower differential shafts.

As described above, one or more upper lay-on rollers 62 may be required in different rewinding applications. This is achieved by using interchangeable lay-on roller assemblies 74 which can be releasably clamped to an upper mounting beam 73 extending between the side plates 72 of the carriage, parallel to the upper differential shaft. A layshaft 90, driven by a motor mounted in the carriage, also extends between the side plates of the carriage, parallel to and spaced above the mounting beam. The layshaft 90 carries spur gears 92, which can be adjustably positioned at any point along the length of the layshaft for driving lay-on rollers clamped at any point on the mounting beam.

The structure of each of the lay-on roller assemblies is as follows. Two support arms 75 mount on a tapered slide 77 along a front face of the mounting beam 73. Clamps 79 enable each support arm to be removably secured at any position along the slide. The lay-on roller assembly further comprises two end plates, each mounted on a respective one of the support arms 75 by means of a pivot 78. A lower end of each end plate 76 is coupled to the respective support arm by a variable-pressure air cylinder 80. Respective ends of the lay-on roller 62 are supported on bearings 82 at an upper end of each end plate 76, the pivots 78 being positioned between the lay-on roller 62 and the air cylinders 80.

The lay-on roller is detachably coupled to a drive assembly 84 by a clutch 86. The clutch is controlled by a variable air supply 88. The drive assembly is mounted on one of the end plates and is driven from the layshaft 90. A spur gear 92 carried by the layshaft meshes with a transfer gear 94 of the drive assembly co-axial with the pivot 78. To complete the drive assembly, a belt 96 transfers drive from a pulley 98 coupled to the transfer gear 94 to a pulley 100 coupled to an input of the clutch 86. The clutch controls the torque transferred from the pulley to the lay-on roller, and can disconnect the drive to allow the lay-on roller to rotate freely.

For different applications, different lay-on roller lengths may be required. The roller length may be changed either by interchanging roller assemblies of different lengths or by replacing the roller itself between two roller assembly end plates, and repositioning the support arms on the mounting beam accordingly.

A microprocessor controls the operation of the slitter rewinder of the embodiment. In order to implement different modes of operation it controls functions including the torque applied to the rewind reel(s) and lay-on roller(s), the position and motion of the carriage, and the pressure between the or each lay-on roller and the respective rewind reel(s) by controlling the pressure admitted to the air cylinders in the or each lay-on roller assembly. Sensors are provided as required to provide feedback signals to the microprocessor to control each of these parameters more precisely.

The operation of the embodiment of FIG. 6 for surface winding of a web will now be described.

In FIG. 6, the upper slit webs pass clockwise around the upper lay-on rollers (it is assumed that a separate lay-on roller is used for each slit web) and are wound anticlockwise onto the rewind reels. As illustrated in FIG. 6, by way of example, the lower slit webs are arranged such that the lower lay-on rollers rotate anticlockwise and the lower rewind reels rotate clockwise. In practice, the upper and lower slit webs would normally be arranged so that both upper and lower rewind reels rotate in the same direction. In surface winding, only the lay-on rollers are driven, the drive torque being controlled by the control of the air supply 88 to the clutch 86. Each rewind reel is allowed to rotate freely on its differential shaft 12, 14. When rewinding starts, the carriage is moved by the carriage drive assembly 32, 34 towards the front of the machine to bring each lay-on roller 62 into contact with the respective rewind reel core, and each slit web is attached to its rewind reel core in known manner. Each lay-on roller is pressed against the corresponding core with a force, or pressure, controlled by the air pressure admitted to the air cylinders 80. Drive is then applied to each lay-on roller and the slit webs rewound onto the reels. As rewinding progresses, the reel diameters increase and the carriage is moved away from the front of the machine accordingly. The position sensor associated with the carriage drive assembly senses the carriage position at all times. In combination with knowledge of the web thickness and the web speed, the outside diameter of the rewind reels can be estimated at any time during rewinding and the carriage positioned accordingly under the control of the microprocessor.

As the carriage is withdrawn during winding, each lay-on roller remains pressed against the surface of its rewind reel at all time, with the pressure determined by the air cylinders 80. The use of air cylinders to apply the lay-on roller pressure allows flexibility for the lay-on rollers to move relative to the carriage to accommodate minor variations in rewind reel diameter while maintaining the appropriate lay-on roller pressure.

When rewinding is complete, the carriage can be traversed further toward the rear of the machine away from the differential shafts to allow access for an operator to remove the rewound reels as described below.

In a further embodiment, the carriage position sensor may be coupled to a sensor for measuring the outside diameter of one or more rewind reels. The carriage could then be moved during rewinding in response to a feedback signal from the reel diameter sensor to ensure more precise positioning of the carriage at all times during rewinding.

As described above, the rewinder illustrated in FIG. 6 may be used to implement any of the rewind geometries illustrated in FIG. 1 to 5. The description above relates to surface winding. Other forms of winding are described below.

Figure 12:
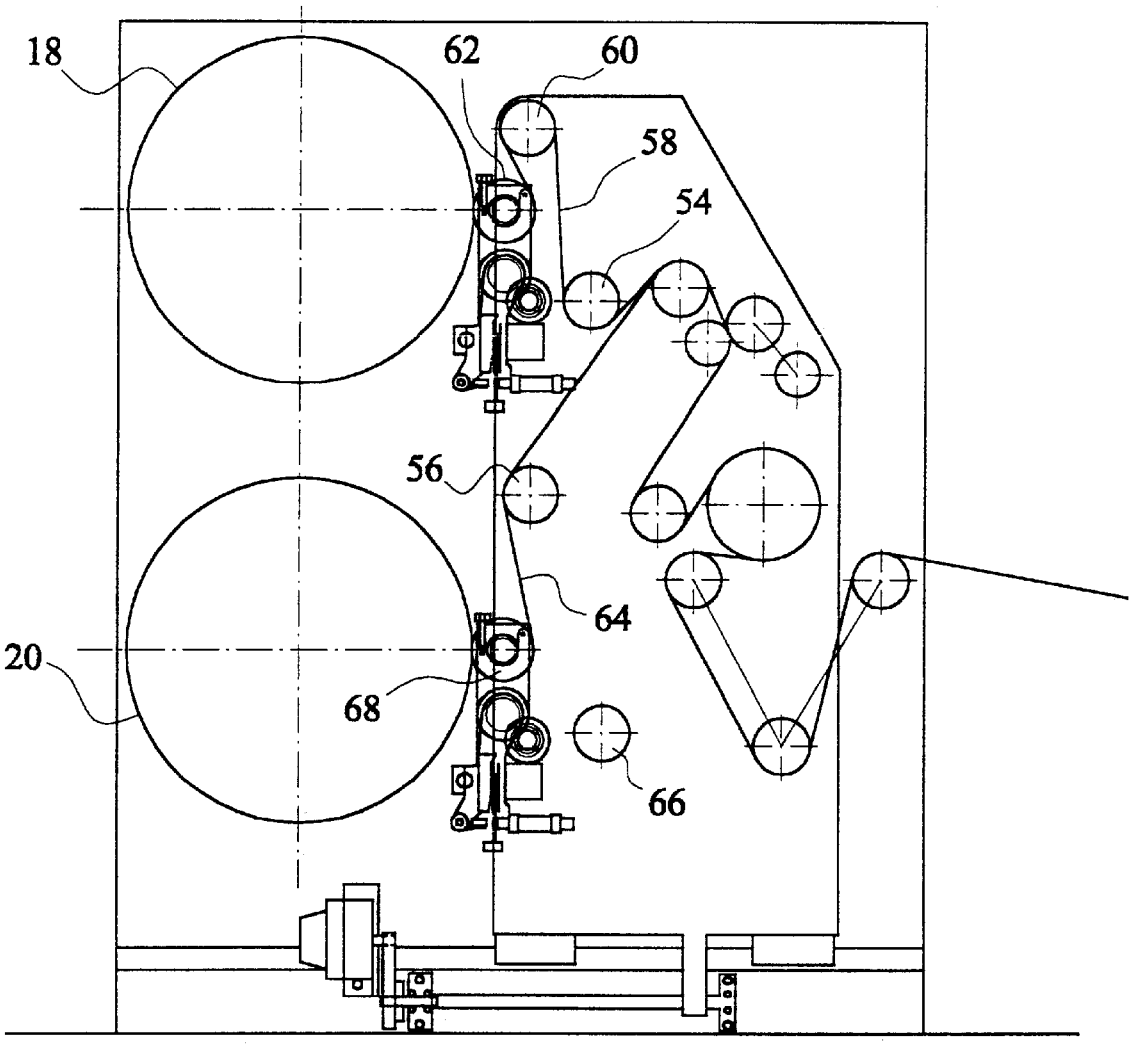
FIG. 12 is a transverse section of the embodiment of FIG. 6 in which the slit webs are arranged for surface winding with both rewind reels rotating anticlockwise.

FIGS. 12 to 15 illustrate the rewinder of FIG. 6 operating in various rewinding geometries. FIG. 12 shows the upper rewind reel configured in the same way as in FIG. 6 but shows the lower slit webs 64 passing directly from the idle roller 56 to the lower lay-on rollers 68 so that both the upper and lower rewind reels rotate anticlockwise and both the upper and lower lay-on rollers rotate clockwise. Identical rewind reels can then be produced on the upper and lower differential shafts. In this geometry, if the rewind reels are driven and the lay-on rollers rotate freely, a centre wind geometry with contact lay-on is achieved. If the lay-on rollers are driven and the rewind reels can rotate freely, a surface wind geometry is achieved. If both the rewind reels and the lay-on rollers are driven, a centre surface winding geometry is achieved.

Figure 13:
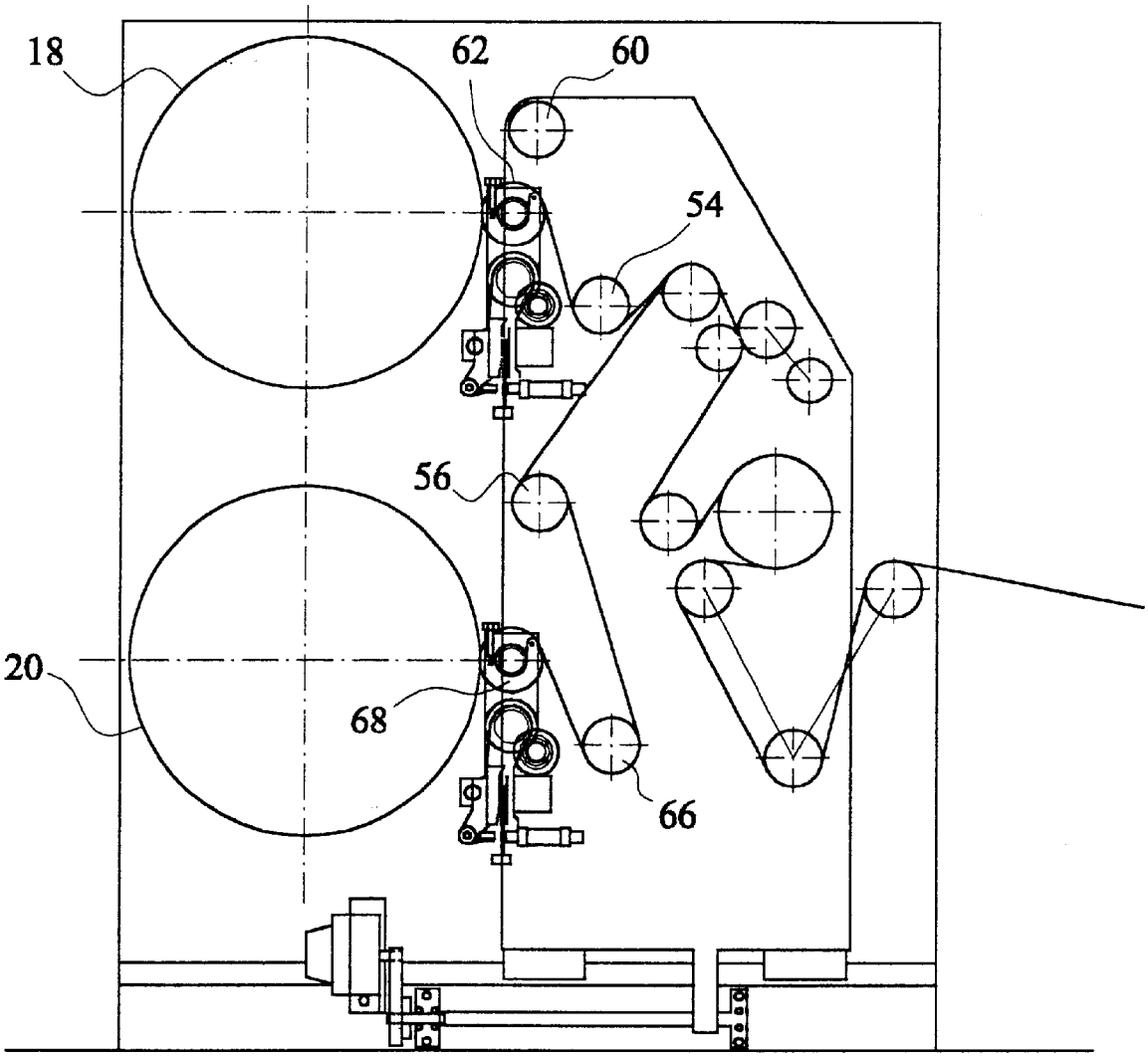
FIG. 13 is a transverse section of the embodiment of FIG. 6 set up for surface winding with both rewind reels rotating clockwise.

In FIG. 13, the lower rewind reels are arranged in the same way as in FIG. 6 but the upper slit webs pass directly from the idle roller 54 to the lay-on rollers 62 so that both upper and lower rewind reels rotate clockwise. Both upper and lower lay-on rollers then rotate anticlockwise. Except for the rewinding direction, the same rewinding geometries are achieved by this layout as discussed above for FIG. 12.

Figure 14:
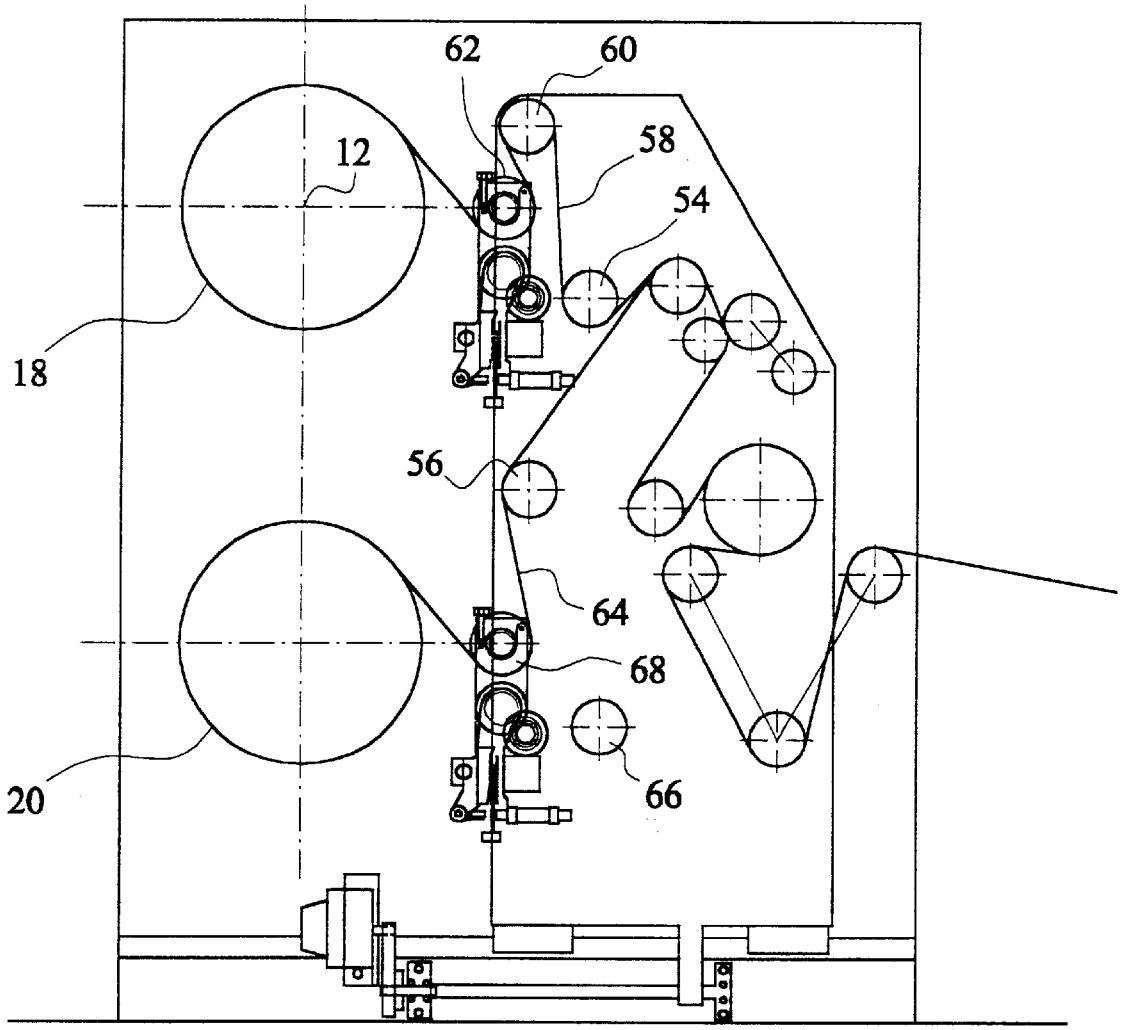
FIG. 14 is a transverse section of the embodiment of FIG. 6 set up for constant gap winding with both rewind reels rotating anticlockwise.

FIG. 14 illustrates a constant gap winding geometry with both upper and lower rewind reels rotating anticlockwise. The upper slit webs pass around the idle roller 54 and the idle roller 60 before passing clockwise around the upper lay-on rollers 62. The lower slit webs 64 pass directly from the idle roller 56 to wrap clockwise around the lower lay-on rollers 68. The rewind reels are driven anticlockwise in this geometry while the lay-on rollers rotate freely. A low torque may additionally be applied to the lay-on rollers to reduce tension in the webs being rewound.

The constant gap geometry is achieved by moving the carriage away from the differential shafts during rewinding to maintain a constant gap between the lay-on rollers and the outer surfaces of the rewind reels.

Figure 15:
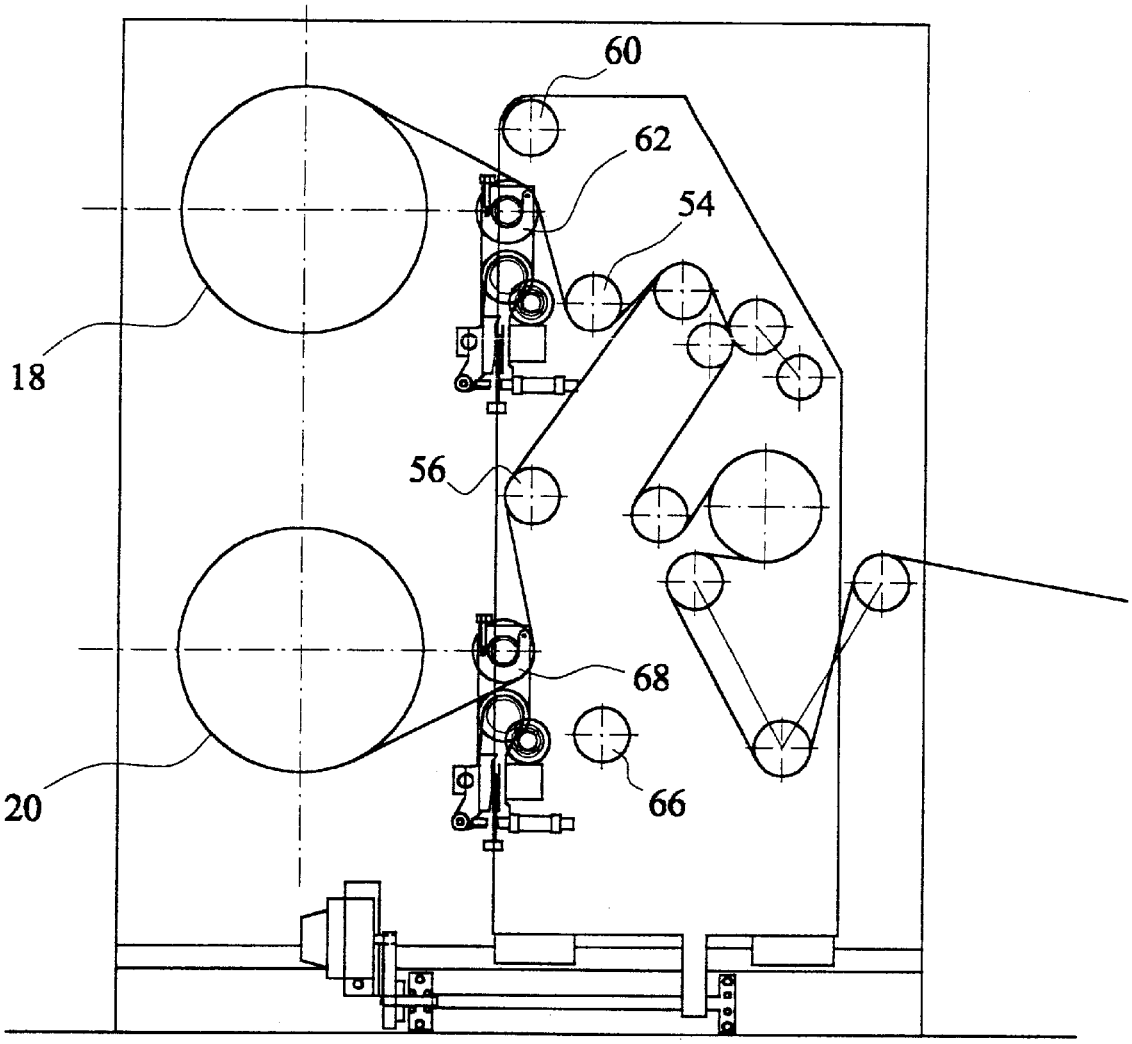
FIG. 15 is a transverse section of the embodiment of FIG. 6 set up for centre winding with the upper reel rotating anticlockwise and the lower reel rotating clockwise.

FIG. 15 illustrates centre winding. In FIG. 15, by way of example, the upper rewind reels are arranged to be driven anticlockwise while the upper slit webs pass from the idle roller 54 and anticlockwise around the upper lay-on rollers 62, and the lower rewind reels are arranged to be driven clockwise while the lower slit webs pass over the idle roller 56 and clockwise around the lower lay-on rollers 68. In centre winding, the lay-on rollers are normally allowed to rotate freely, although some torque may be applied to control web tension. In centre winding, there may be no need to move the carriage. The carriage may be held in a fixed position spaced from the rewind reels as illustrated in FIG. 15 throughout rewinding.

Loading and Unloading

Figure 10:
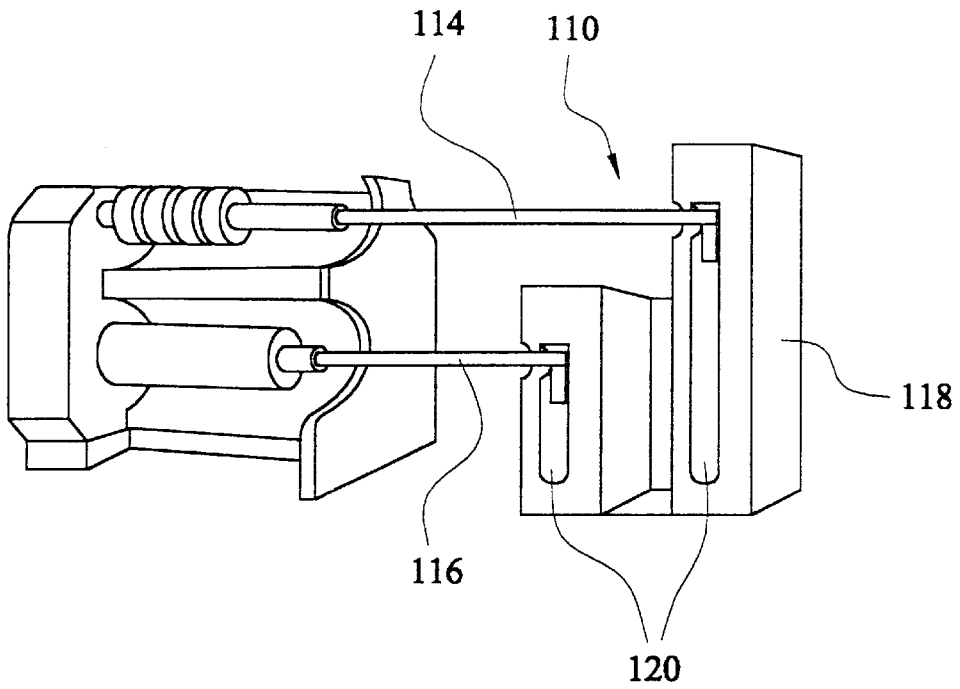
FIG. 10 is a perspective view of the embodiment of FIG. 6 prepared for unloading.

FIGS. 10 and 11 illustrate the embodiment of FIG. 6 cooperating with a reel-handling machine 110. As described above, the differential shafts 12, 14 of the rewinder are cantilevered from the motor unit 16. However, during rewinding the free ends of the differential shafts are supported by a support plate 112 which is removably fastened to a portion of the housing of the rewinder 10 as shown in FIG. 11. For unloading reels, the support plate 112 is removed as shown in FIG. 10. The unloading machine 110 comprises two reel-support shafts 114, 116 corresponding to the differential shafts 12, 14. For unloading rewound reels, these arms are aligned with the differential shafts and the reels slid from the differential shafts on to the support arms. The support arms are pivotably mounted on a base portion 118 of the reel-handling machine so that when the reels have been slid onto the support arms, the arms can be swung away from the rewinder. The support arms can then be lowered in slides 120, for example to place the reels onto a pallet.

This type of reel-handling machine is known, and various other types of known reel-handling equipment can also conveniently be used in combination with the rewinder of the embodiment. Therefore, an advantage of this aspect of the invention is the ability to use conventional reel-handling equipment in combination with a rewinder which can implement all of the winding geometries described herein. Duplex rewinders with cantilevered differential shafts are known for centre winding geometries but the embodiment of the invention extends the ease of reel handling in such machines to a machine capable of more complex winding geometries.

Although the various winding geometries described above can be produced individually on various conventional machines, the embodiment of the invention advantageously permits all of these rewinding geometries to be implemented by a single, more flexible machine, which also retains the conventional duplex layout and can take advantage of existing reel handling equipment in use world wide.

In particular, the arrangement of the embodiment overcomes known problems with unloading centre surface rewinding machines. This is because the shafts on which the rewinding reels are mounted in the embodiment are fixed, enabling unloading from the ends of the shafts. By contrast, the rewinding reels in conventional centre surface winding machines are moveable and a common, fixed lay-on shaft is used. In such machines, as each rewinding reel increases in diameter during rewinding, the reel axis moves away from the fixed lay-on roller. This means that the shaft on which the reel is mounted can not be cantilevered from one end, which precludes unloading from the end of the shaft.

In the embodiment of the invention, slitting accuracy may advantageously be improved compared with a conventional centre winding machine because the slitting equipment can be kept at a fixed distance from the rewinding reel and the relative positions of the rewind reel, roller and slitting knives can remain fixed throughout rewinding. (As described above, the embodiment of the invention may perform centre winding either with the carriage fixed or with the carriage moving to maintain a constant gap winding geometry). In a conventional centre winder, the position of the slitting equipment is fixed and therefore the distance from the slitting equipment to the rewinding reel and the relative positions of the components of the machine change during rewinding.

Figure 1:
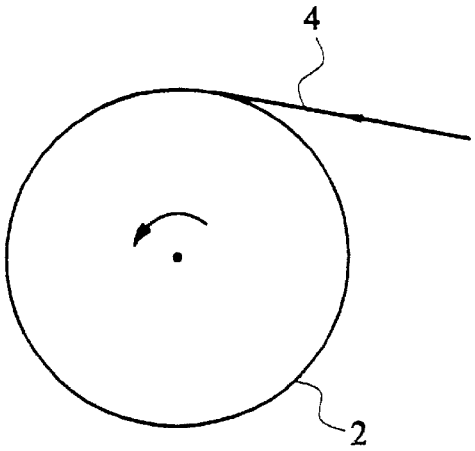
FIG. 1 illustrates the prior art centre wind geometry.
Figure 2:
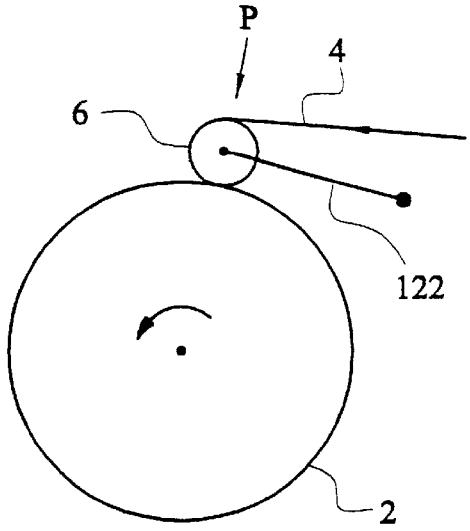
FIG. 2 illustrates the prior art centre wind with contact lay-on geometry.
Figure 3:
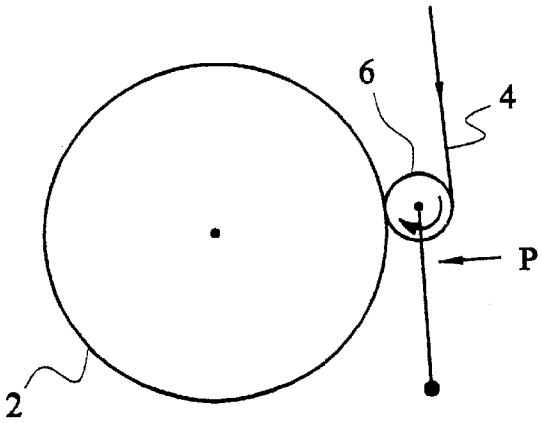
FIG. 3 illustrates the prior art surface wind geometry.
Figure 4:
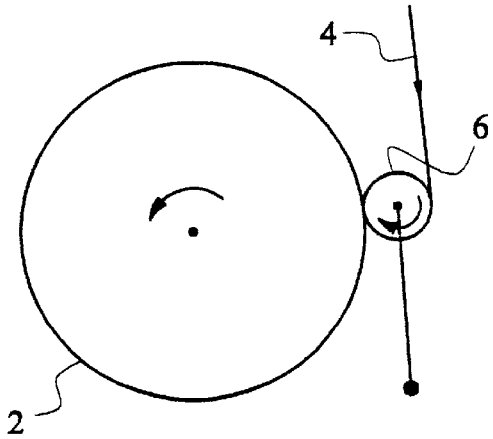
FIG. 4 illustrates the prior art centre surface wind geometry.
Figure 5:
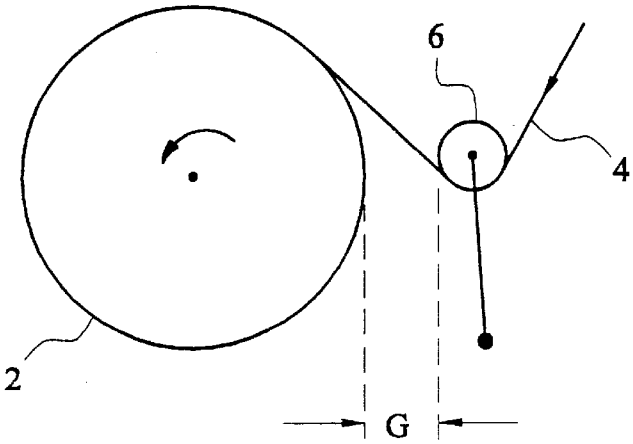
FIG. 5 illustrates the prior art constant gap winding geometry.

In the embodiment, the lay-on roller geometry is improved by comparison with a conventional centre winder with lay-on. This is because the geometry of the lay-on roller and the rewind reel does not change as the reel diameter increases. In a conventional centre winder with lay-on, the lay-on roller is usually positioned above the rewind reel and is mounted between the ends of a pair of cranks 122 as shown in FIG. 2. Thus, the lay-on pressure changes as the rewind reel changes diameter and the angle of the crank changes in response. In the embodiment of the invention, the lay-on pressure is also more accurately maintained during rewinding due to the lower inertia of the lay-on roller of the embodiment compared with the crank-mounted lay-on roller of the prior art. The reduced inertia reduces pressure hysteresis and roller bounce.

In the embodiment, advantageously no equipment change is necessary to change between the following winding formats: centre winding with differential slip and lock bar, centre winding with lay-on in differential and lock bar, surface winding with differential and lock bar, centre surface winding with differential and lock bar, and constant gap winding with differential and lock bar winding. With additional equipment, individual lay-on roller assemblies may be added for all these winding processes, giving each finished reel its own lay-on or surface drive down to a reel width of 45 mm and up to the full winding width of the machine.

In summary, the invention as embodied herein provides a rewinder machine and a method of operating a rewinder machine which flexibly incorporate a wide variety of winding technologies into a single system while, in a second aspect, surface drive winding is enabled within a system having a removable and moving lay-on roller assembly without affecting the dynamics of the roller assembly. In a further aspect, the invention as embodied herein enables surface winding while retaining the ease of reel unloading associated with conventional centre winding apparatus.

What is claimed is:

1. An apparatus for rewinding a plurality of webs onto respective ones of a corresponding plurality of rewind reels, comprising;

a shaft for carrying said plurality of rewind reels and applying a predetermined torque to each said rewind reel, said torque optionally being of zero magnitude;

a plurality of rollers, each said roller being for guiding or laying-on a respective one of said webs onto a respective one of said rewind reels;

a drive apparatus for applying a predetermined torque to each said roller, said torque optionally being of zero magnitude; and a carriage supporting said plurality of rollers, and traversable relative to said shaft so that said rollers are moveable relative to said shaft during rewinding.

2. An apparatus according to claim 1, in which said shaft is one of a pair of parallel shafts, each for carrying one or more of the plurality of rewind reels and applying said predetermined torque to each said rewind reel, said torque optionally being of zero magnitude.

3. An apparatus according to claim 1, in which said carriage supports each said roller by means of a roller assembly incorporating a pressure control element to maintain a predetermined pressure between said rewind reel and said roller.

4. An apparatus according to claim 1, further comprising a slitting means for slitting a feed web, each said web for rewinding being a slit web.

5. An apparatus according to claim 4, in which said slitting means is mounted on said carriage.

6. An apparatus according to claim 1, in which said carriage comprises a mounting beam to which a respective roller assembly incorporating each said roller is securable.

7. An apparatus according to claim 6, in which said drive apparatus comprises a layshaft parallel to said mounting beam and a respective drive assembly associated with each said roller assembly, drive being transferable from said layshaft, through said drive assembly, to said roller.

8. An apparatus according to claim 7, in which each said drive assembly comprises a controllable clutch to control said torque applied to said roller.

9. An apparatus according to claim 6, in which one or more of said roller assemblies is securable to said mounting beam for guiding or laying-on a corresponding number of said webs onto respective ones of a corresponding number of rewind reels carried by said shaft.

10. An apparatus according to claim 1, in which said shaft is cantilevered such that reels are unloadable from a free end of said shaft.

11. An apparatus according to claim 1, further comprising a means for controlling said movement of said roller relative to said shaft, said torque applied to said rewind reel and said torque applied to said roller in order to implement any predetermined one of the following rewinding geometries; centre winding, centre winding with lay-on, surface winding, centre surface winding, and constant gap winding.

12. An apparatus according to claim 1, in which said axis of said shaft is horizontally oriented and said carriage is moveable in a horizontal direction perpendicular to said shaft axis.

13. An apparatus according to claim 2, in which said parallel shafts are vertically spaced from each other.

14. The apparatus of claim 3 wherein said pressure control element is pneumatically driven.

* * * * *